United States Patent [19]

Ury et al.

[11] Patent Number: 4,504,768

[45] Date of Patent: Mar. 12, 1985

[54] ELECTRODELESS LAMP USING A SINGLE MAGNETRON AND IMPROVED LAMP ENVELOPE THEREFOR

[75] Inventors: Michael G. Ury, Bethesda; Charles H. Wood, Rockville; Patrick J. Ryan, Laurel, all of Md.

[73] Assignee: Fusion Systems Corporation, Rockville, Md.

[21] Appl. No.: 393,856

[22] Filed: Jun. 30, 1982

[51] Int. Cl.[3] ..... H05B 41/16; H05B 41/24

[52] U.S. Cl. ..... 315/248; 313/611; 315/39; 315/267

[58] Field of Search ..... 315/39, 248, 267; 313/611

[56] References Cited

U.S. PATENT DOCUMENTS

| | | | |
|---|---|---|---|
| 1,698,691 | 1/1929 | Buttolph | 315/248 X |
| 1,808,826 | 6/1931 | Teasdale | 313/611 X |
| 2,148,017 | 2/1939 | Germer | 313/611 X |
| 2,975,330 | 3/1961 | Bloom et al. | 315/248 X |
| 3,872,349 | 3/1975 | Spero et al. | 315/39 |
| 4,042,850 | 8/1977 | Ury et al. | 315/39 |
| 4,266,162 | 5/1981 | McNeill et al. | 315/39 |
| 4,359,668 | 11/1982 | Ury | 315/39 |

*Primary Examiner*—Saxfield Chatmon

*Attorney, Agent, or Firm*—Pollock, Vande Sande & Priddy

[57] ABSTRACT

A microwave generated electrodeless lamp using a single magnetron, and an improved lamp envelope therefor. An elongated lamp envelope containing a plasma forming medium is disposed in a microwave chamber comprised of a reflector and mesh. The reflector includes a pair of coupling slots, each of which is disposed equidistant from the ends of the lamp envelope. A waveguide means is provided which has a wall which is comprised of a portion of the reflector which includes the slots, and has means for introducing microwave energy thereto at an area equidistant from the two slots so that the energy couples equally to the slots. When the frequency of the microwave energy and chamber dimensions are arranged so that a symmetrical standing wave exists in the chamber, a balanced system results wherein after a short start-up period, approximately equal light output is obtained from the respective ends of the lamp envelop. In order to prevent recondensation of the envelope fill during operation at areas of low temperature, an improved envelope is provided in which such areas are severly tapered to cause hotter operation thereat.

1 Claim, 8 Drawing Figures

ELECTRODELESS LAMP USING A SINGLE MAGNETRON AND IMPROVED LAMP ENVELOPE THEREFOR

The present invention is directed to an improved microwave generated electrodeless lamp, and to an improved lamp envelope or bulb therefor.

In recent years, microwave generated electrodeless lamps have found extensive use in industry for curing inks and coatings. Typically, such lamps for industrial applications are comprised of a microwave chamber in which a longitudinally extending envelope containing a plasma forming medium is disposed. The microwave chamber is comprised of a reflector for reflecting light emitted by the envelope and a mesh which is opaque to the microwave energy within the chamber, but transparent to the emitted light for allowing it to exit therefrom. The lamp is excited by microwave energy which is generated by one or more magnetrons and which is coupled to the chamber through coupling slots which are located in the reflector.

In U.S. Pat. No. 3,872,349, assigned to the same assignee as the present application, a particular embodiment of such a lamp is illustrated in FIGS. 19 and 20. In the illustrated lamp, a microwave enclosure is mounted on top of the reflector portion of the chamber in such manner that part of the reflector forms a wall of the resultant waveguide means, while a magnetron is disposed at one end of the waveguide means and at least one coupling slot is located in the reflector at the other end. Unfortunately, it was found that operation of this configuration utilizing a single magnetron resulted in preferential absorption of microwave energy at one end of the lamp envelope, and consequent greater light output at that end.

In U.S. Pat. No. 4,042,850, also assigned to the assignee of the present application the Figures illustrate an electrodeless lamp which utilizes two magnetrons, each of which is coupled through a respective waveguide to coupling slots which are located at respective ends of the microwave chamber. By utilizing two magnetrons and arranging the outputs thereof to be approximately equal, balanced operation is achieved wherein approximately equal light output is obtained from both ends of the plasma forming medium-containing envelope.

It is now desired to provide an electrodeless lamp which uses only a single magnetron, but nevertheless affords balanced operation, thereby providing equal light output from respective ends of the lamp envelope.

In accordance with the invention, this is achieved by providing a microwave chamber having coupling slots which are disposed equidistant from the ends of the lamp envelope, and providing a waveguide means having a wall which is comprised of a portion of the microwave chamber which includes the two slots. Additionally, the waveguide means includes provision for introducing microwave energy thereto at an area equidistant from the two slots so that the magnetron couples energy equally to both slots. When the frequency of the microwave energy and chamber dimensions are arranged so that a symmetrical standing wave exists in the chamber, a balanced system results wherein after a short start-up period, approximately equal light output is obtained from the respective ends of the lamp envelope. The lamp provided is substantially shorter in length than that described in Pat. Nos. 3,872,349 and 4,042,850, a factor which in addition to the novel structure of the invention allows a single magnetron to be used.

Since the above-mentioned standing wave in the microwave chamber has a null which is disposed at the middle of the length of the envelope, the temperature of the middle of the envelope falls significantly below the average envelope temperature, which may cause the mercury fill in the middle portion to re-condense to liquid form, thereby lowering the pressure in the envelope and interfering with satisfactory lamp performance. According to a further aspect of the present invention, such re-condensation is prevented by tapering the lamp envelope from an area on each side of the middle of the envelope length to the envelope middle, in such manner that the internal diameter at the middle is only from 10 to 30% as large as the internal diameter of the ends of the envelope. This causes the envelope to run hotter in the middle, and the mercury fill remains in gaseous form throughout.

It is thus an object of the present invention to provide an improved microwave generated electrodeless lamp.

It is a further object of the invention to provide a microwave generated electrodeless lamp having a balanced light output.

It is a further object of the invention to provide a microwave generated electrodeless lamp which, to a substantial extent avoids hot spots.

It is still a further object of the invention to provide a microwave generated electrodeless lamp which efficiently couples microwave energy to the plasma forming medium.

It is still a further object of the present invention to provide a microwave generated electrodeless lamp in which the mercury fill does not re-condense to liquid form during operation.

It is still a further object of the invention to provide an improved lamp envelope for a microwave generated electrodeless lamp.

The invention will be better understood by referring to the accompanying drawings in which.

Figure 1:
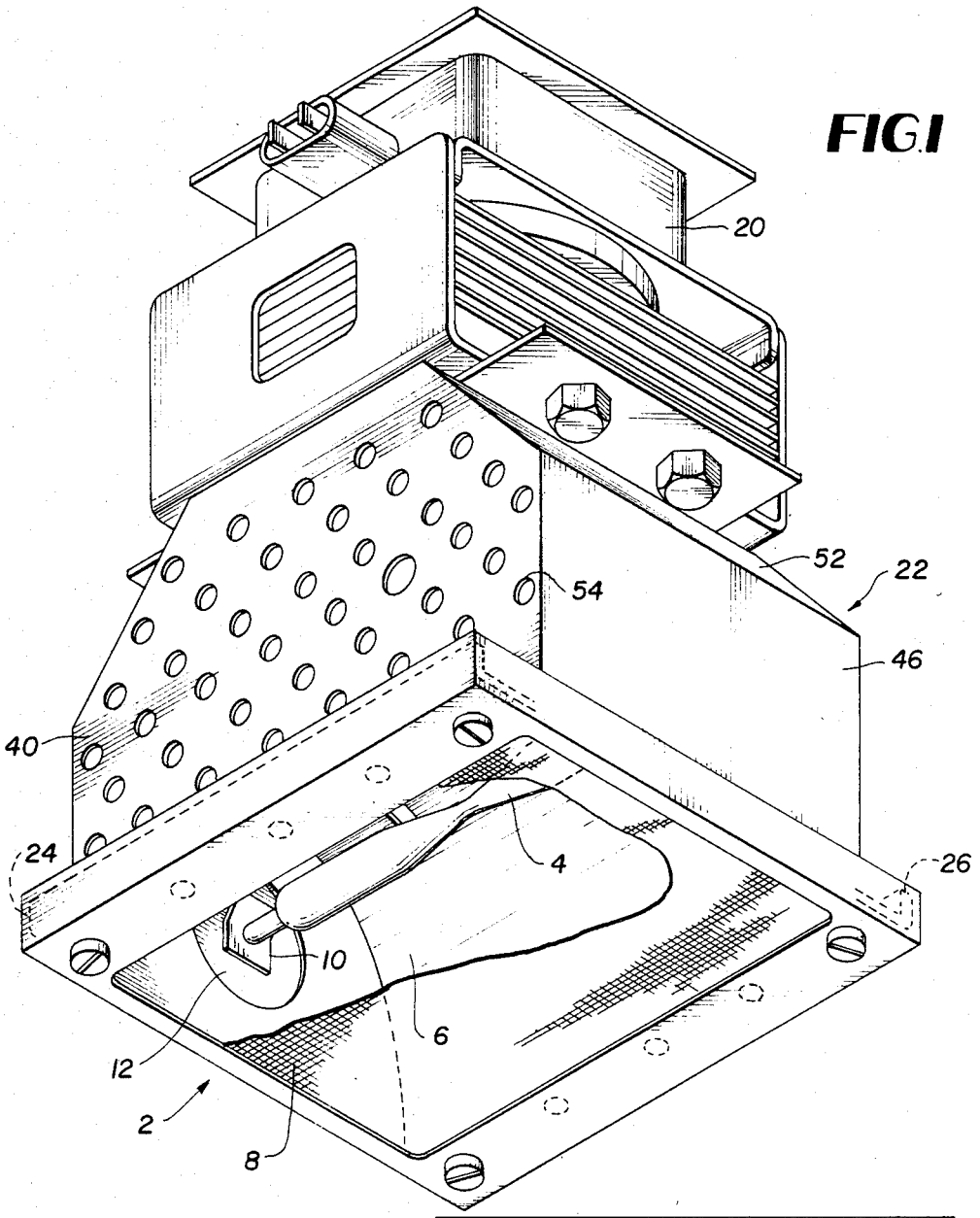
FIG. 1 is an illustration of an embodiment of a microwave generated electrodeless lamp in accordance with the invention.

An embodiment of a microwave generated electrodeless lamp in accordance with the invention is illustrated in FIGS. 1 to 4. Referring to the Figures, the lamp is seen to be comprised of microwave chamber 2 in which elongated lamp envelope 4 which contains a plasma forming medium, is disposed. The microwave chamber is comprised of metallic reflector 6 and metallic mesh 8, which is only partly shown in FIG. 1, but which covers the entire bottom of the reflector. Reflector 6 is of an elliptical, parabolic or other shape, and is effective to reflect ultraviolet or other light emitted by lamp envelope 4 out of the chamber through mesh 8. The mesh is made of metallic material, and is effectively opaque to microwave energy while being effectively transparent to radiation in the ultraviolet and visible part of the spectrum. For example, when operating at a frequency of 2450 Mhz, the mesh may be a grid of 0.0017" diameter wires having a spacing of 0.033" between wire centers.

Lamp envelope 4 is typically made of quartz, and is secured in the reflector by leaf spring fingers 10 which are located in recesses 12 in the reflector ends 14. The reflector has two couping slots 16 and 18 disposed therein, located equidistant from the chamber ends and from the ends of the lamp envelope 4.

Figure 3:
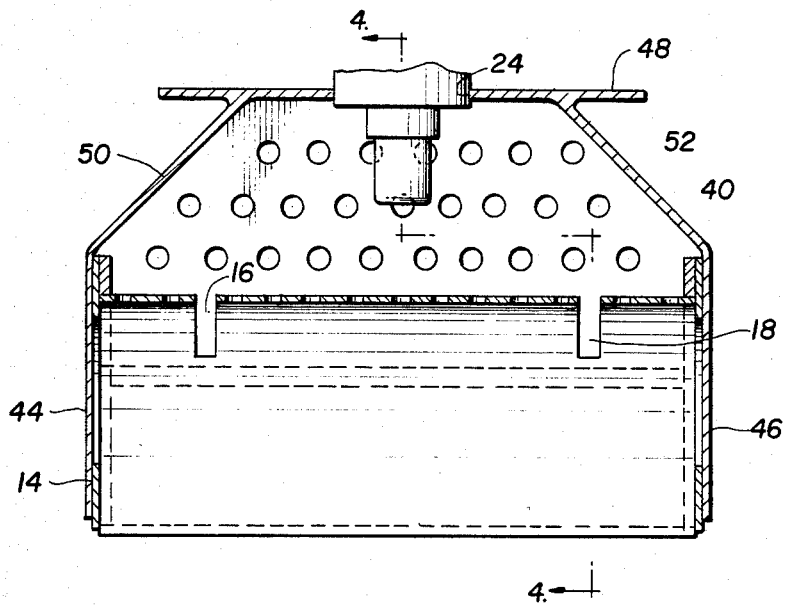
FIG. 3 is a sectional view of the lamp on section lines 3—3 of FIG. 2.
Figure 4:
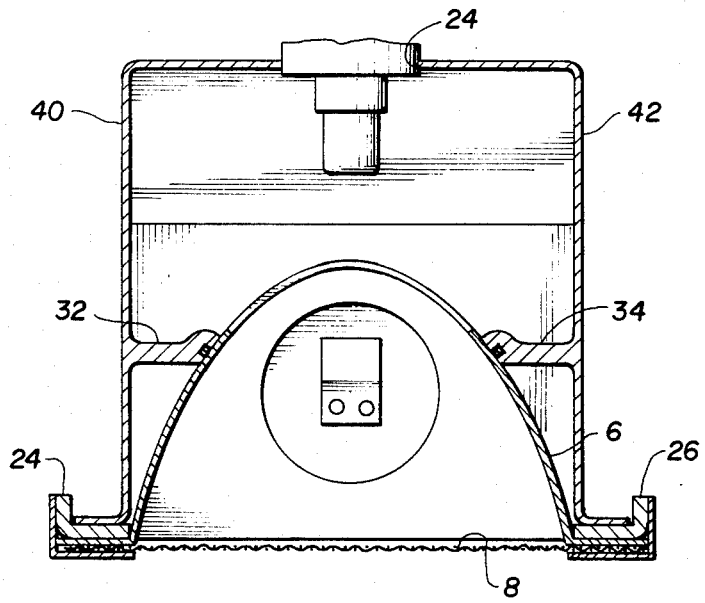
FIG. 4 is a sectional view of the lamp on section lines 4—4 of FIG. 3.

Referring to FIG. 1, microwave energy is generated by magnetron 20. In order to effectively couple the energy generated to coupling slots 16 and 18 and the medium in envelope 4, metallic inverted box structure 22 is provided. Referring to FIGS. 1, 3, and 4, it will be seen that the structure is comprised of sidewall members 40, and 42, end wall members 44 and 46, top member 48, and angularly disposed members 50 and 52. Structure 22 fits over reflector 6 as illustrated in FIGS. 1 and 4, and the structure in combination with the reflector forms a microwave enclosure or waveguide means for transferring microwave energy to the coupling slots. The magnetron launcher is disposed in opening 24 which is located equidistant from the chamber ends, and the launcher is thus located in the waveguide means equidistant from the coupling slots. The bottom of inverted box-like structure 22 has flanges 24 and 26 which may be secured to cooperating flanges 28 and 30 which extend from the reflector, for example by being screwed thereto.

Figure 2:
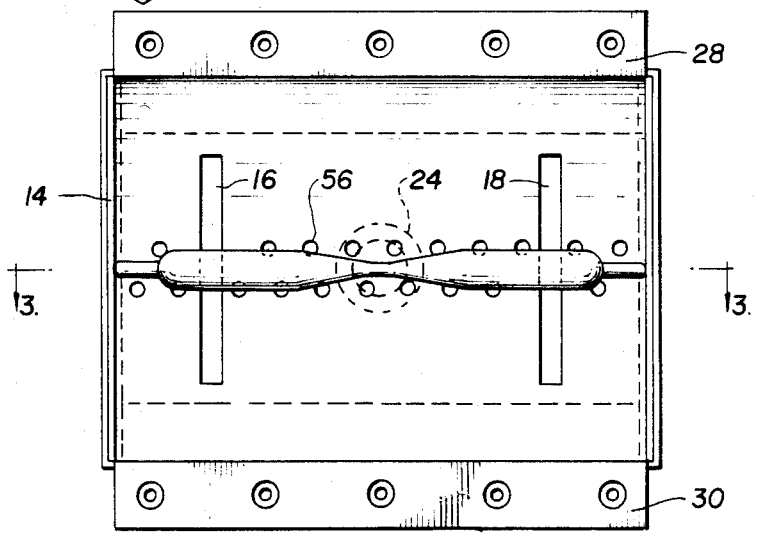
FIG. 2 is a bottom view of the electrodeless lamp depicted in FIG. 1.

In the preferred embodiment, structure 22 has members 32 and 34 shown in FIG. 4 running along the length of the inside of sidewalls 40 and 42 and connecting these sidewalls to the reflector. Members 32 and 34 have the effect of shortening the height of the waveguide means, and providing for more efficient coupling of the microwave energy to slots 16 and 18. Additionally, the sidewalls of the waveguide means have cooling holes 54 therein and reflector 6 has cooling holes 56 along the top, as shown in FIG. 2. The lamp is cooled by pushing or pulling air or other cooling gas through the waveguide means and microwave chamber past the lamp envelope.

The frequency of the microwave energy generated by magnetron 20 and the longitudinal dimension of chamber 2 are arranged so that during operation a symmetrical standing wave exists in the microwave chamber which has a minimum or null at the middle of the chamber in the longitudinal direction. When so energized, the unique microwave coupling structure illustrated in FIGS. 1 to 4 couples microwave energy to envelope 4 in such manner that the envelope produces a balanced output across its length.

Figure 6:
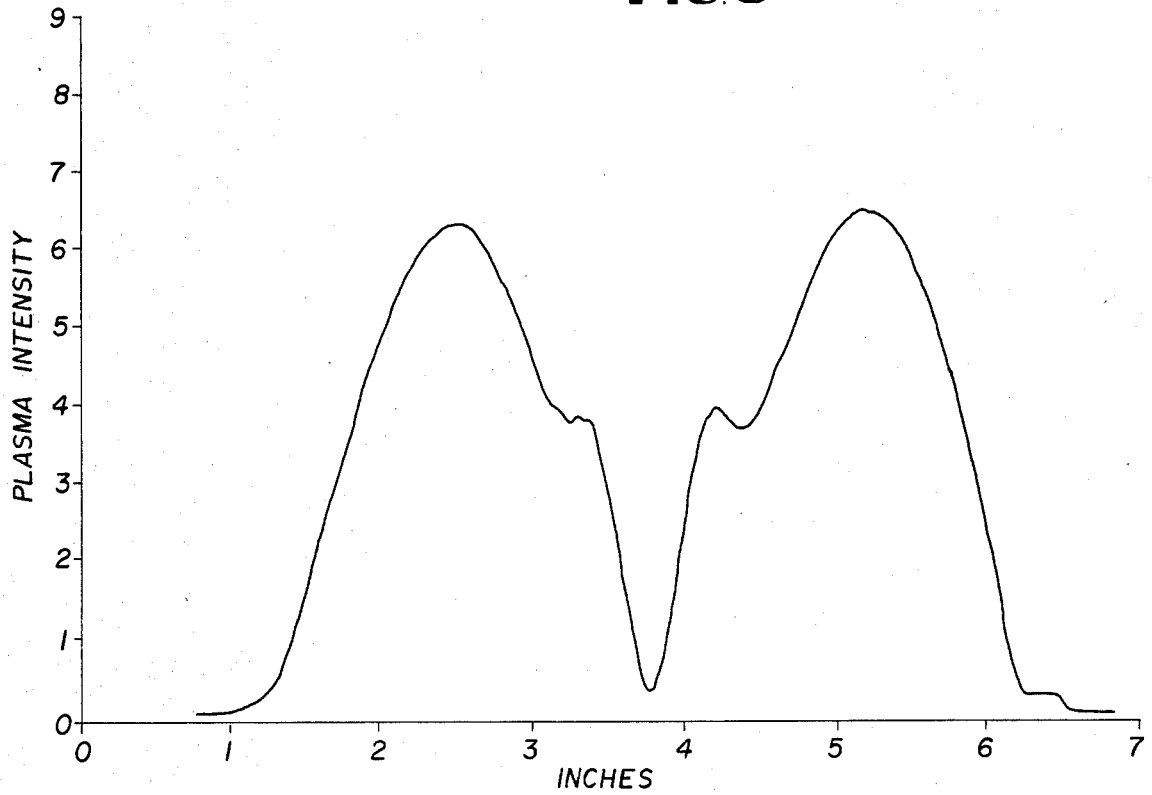
FIG. 6 is a graph of lamp output intensity measured at a very narrow acceptance angle as a function of envelope position.

This is illustrated in FIG. 6, which is a graph of lamp output intensity versus longitudinal envelope position measured at a very narrow acceptance angle, so that only the light contribution emitted at the particular envelope position denoted is measured. It is seen that equal intensity maxima occur at respective ends of the envelope, and that symmetrical and balanced operation is attained. The reason for this is not completely understood, but it is has been determined that unbalanced operation initially occurs, and that within several seconds after start-up, balanced operation is attained. When the lamp is not in operation, the mercury or other fill gas condenses as liquid droplets on the envelope wall. Since condensation is unequal across the envelope length, initial operation is unbalanced. However, it is believed that when more microwave energy is absorbed at areas of greater mercury concentration, these areas become hotter, causing local pressure to rise, which in turn causes the plasma to flow to areas of lower pressure, thus smoothing pressure variations and tending to balance light output. In tests run, it was determined that at start-up the two maxima shown in FIG. 6 were unequal, but that within several second after ignition, balancing occurred.

Figure 7:
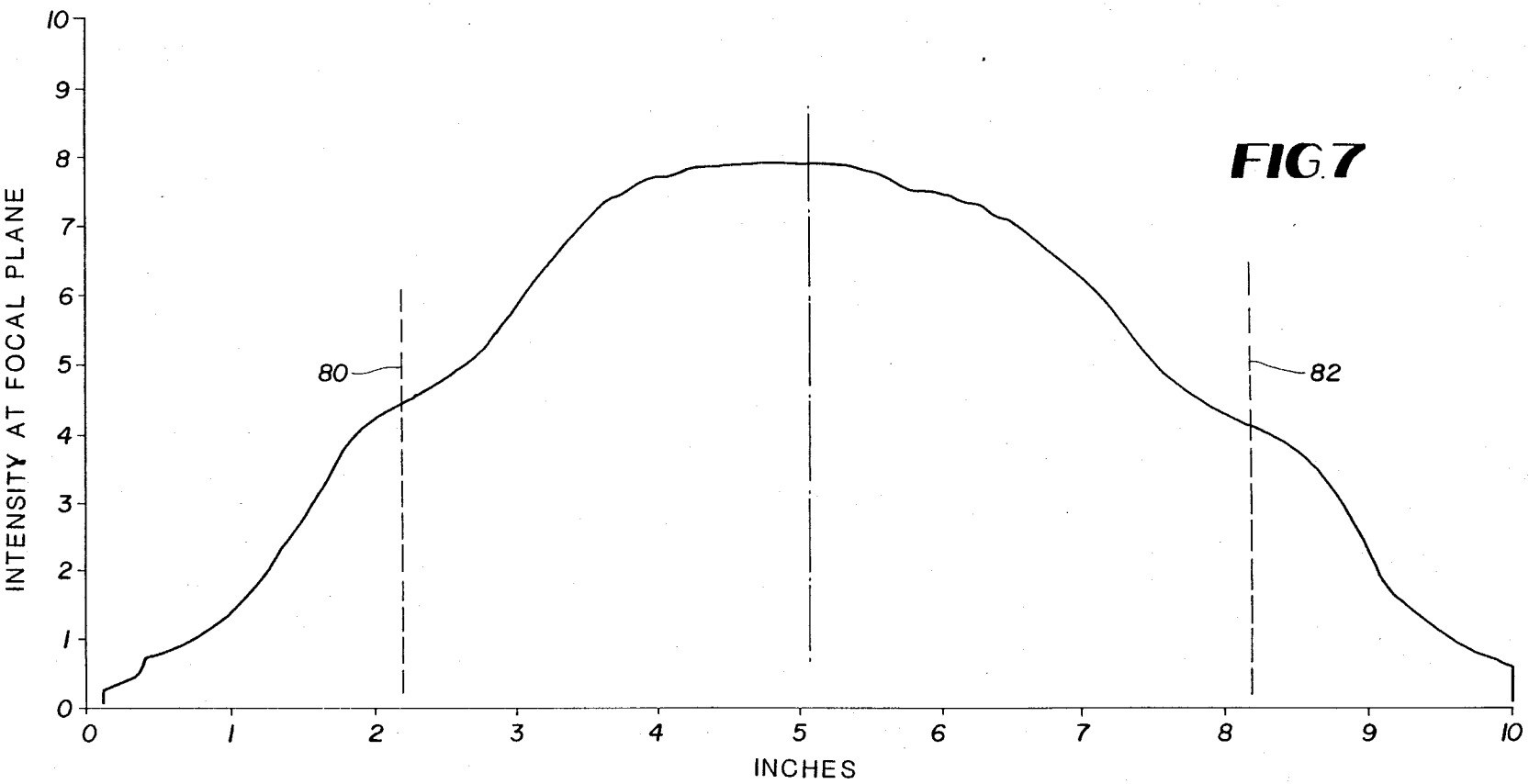
FIG. 7 is a graph of the irradiance of the lamp at the focal plane as a function of envelope position.

When the lamp depicted in FIG. 1 is employed in a process line, an output of equal intensity is desired at the focal plane along the middle portion of the lamp. The lamp provides maximum irradiance at its middle, since direct rays from the entire length of the lamp envelope along with rays reflected from the end reflectors strike the focal plane near the middle area. A graph of the irradiance at the focal plane as a function of envelope position is shown in FIG. 7, and in order to get even irradiance at the middle, it is necessary that the maxima shown in FIG. 6 be equal.

Since as shown in FIG. 6, a minimum of energy absorption occurs at the middle of the envelope, this area tends to run cool, and the mercury fill may re-condense to a liquid, decreasing bulb efficiency and having other deleterious effects on lamp operation. In accordance with a further aspect of the invention, a novel lamp envelope is provided to prevent such re-condensation and retain the fill in gaseous form throughout the envelope.

Figure 5:
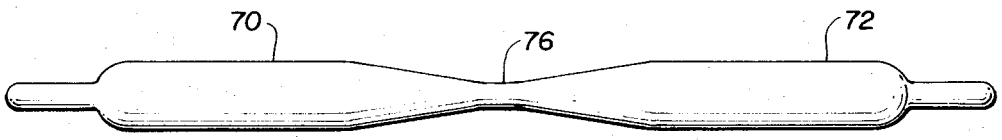
FIG. 5 is an illustration of the improved lamp envelope of the invention.

An improved lamp envelope in accordance with the invention is illustrated in FIG. 5, and is seen to have cylindrical portions 70 and 72, but to be severely tapered in a conical shape from areas on each side of the middle 76 of the envelope length to the middle. The internal diameter at the middle is only from 10% to 30% as large as the internal diameter at the ends. While envelopes having slightly tapered middle portions have been used in the prior art by the assignee of this application, to the applicants' knowledge envelopes have never before been tapered for the purpose of controlling operating temperature.

Figure 8:
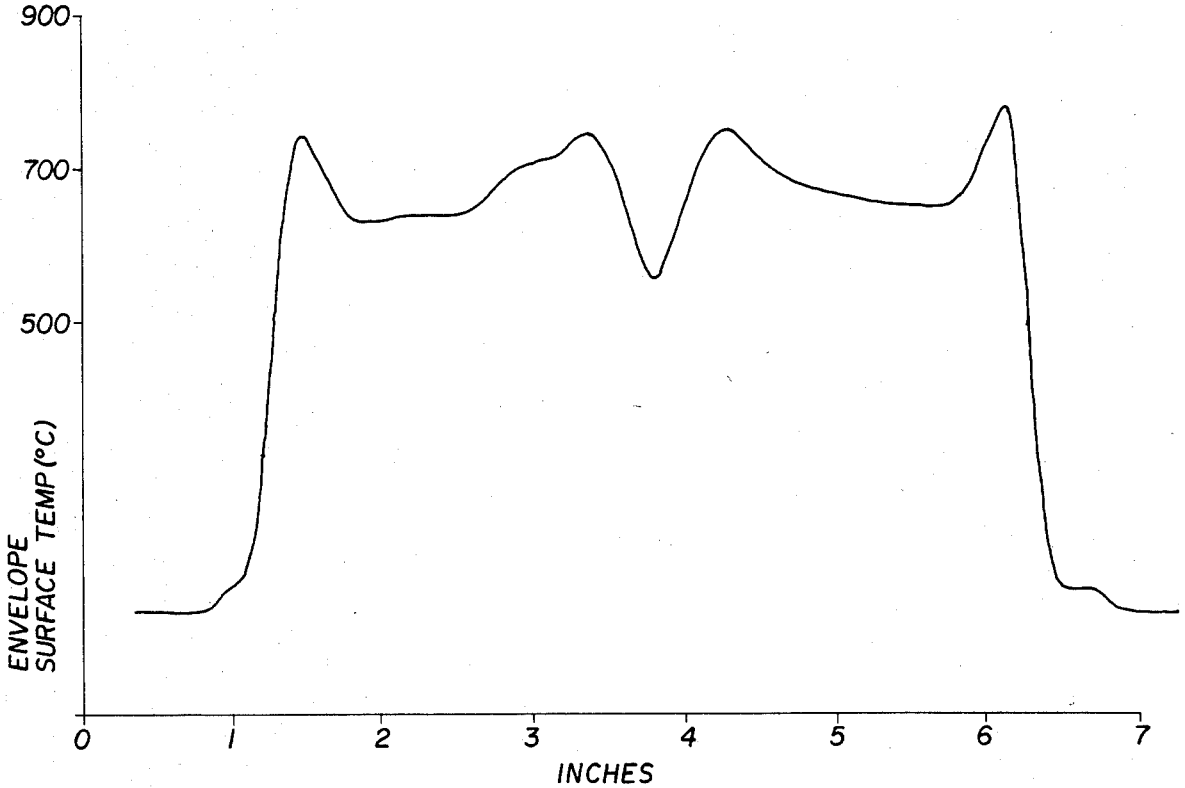
FIG. 8 is a graph of envelope surface temperature as a function of envelope position.

The small internal diameter at middle portion 76 causes such portion to run hotter than it would run if the diameter were not altered. A graph of envelope surface temperature versus envelope position is illustrated in FIG. 8, and it should be observed that while the minimum temperature still occurs at the middle of the envelope, the temperature is retained in the region between 500° C.–550° C., which is hot enough to prevent mercury re-condensation.

In the preferred embodiment of the invention, the internal diameter of the cylindrical portion of the bulb is 9 mm, while the internal diameter at the bulb middle is only 1.5 mm. If a substantially larger diameter were used at the middle, re-condensation would occur, and proper operation would not be attained.

In an actual embodiment of the invention, the microwave chamber is $6\frac{1}{8}$" long and $4\frac{1}{4}$" wide on the bottom. The coupling slots are located $1\frac{1}{2}$" in from the chamber ends, and the envelope is as described above. The box-like structure 22 is of the same nominal length and width as the chamber, while the ends are $2\frac{5}{8}$" high and the top is $2\frac{1}{8}''$ long. Additionally, the magnetron outputs microwave energy at a nominal frequency of 2450 Mhz.

There thus has been disclosed an improved microwave generated electrodeless lamp which achieves balanced operation with a single magnetron, and an improved lamp envelope for use therewith. It should be appreciated that while only a preferred embodiment of the invention has been disclosed, variations falling within the scope of the invention will occur to those skilled in the art. For example, instead of using a single pair of coupling slots, operation with a plurality of pairs, each symmetrical with respect to the chamber middle is possible. Also, while a lamp envelope having only one tapered portion is disclosed, if the standing wave in the chamber has a plurality of nulls instead of a single null, an envelope having a corresponding plurality of tapered portions would be employed.

It therefore should be understood that the invention is limited only by the claims appended hereto and equivalents.

We claim:

1. A microwave generated plasma lamp for providing electromagnetic radiation, comprising:

a microwave chamber comprised of a reflector means and a mesh member, said microwave chamber having a long dimension which extends in a first direction;

an elongated lamp envelope containing a plasma forming medium disposed in said microwave chamber so as to extend in said first direction;

said reflector means having a pair of coupling slots disposed therein, said coupling slots being disposed approximately equidistant from said chamber ends and from the ends of said envelope, at respective positions nearer to said envelope ends than to the middle of said envelope;

means for generating microwave energy;

means for coupling said generated microwave energy to said coupling slots in said reflector means;

said coupling means including waveguide means comprising a single microwave enclosure defined by a plurality of wall members and having a dimension extending in said first direction, one of said wall members comprising a portion of said reflector means which includes said pair of coupling slots, and said means for generating microwave energy being disposed at an area of said enclosure which is approximately in the center thereof in said first direction and approximately equidistant between said coupling slots in said first direction, and the frequency of the microwave energy generated by said means for generating microwave energy and the dimension of said microwave chamber in said first direction being such that when said lamp is excited with said microwave energy a standing wave which is symmetrical in said chamber along said first direction and has at least one null exists in said chamber.

* * * * *